US008277022B2

(12) United States Patent
Shimazaki

(10) Patent No.: US 8,277,022 B2
(45) Date of Patent: Oct. 2, 2012

(54) FLUID EJECTION APPARATUS

(75) Inventor: Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 13/026,998

(22) Filed: Feb. 14, 2011

(65) Prior Publication Data

US 2011/0134186 A1 Jun. 9, 2011

Related U.S. Application Data

(63) Continuation of application No. 12/250,674, filed on Oct. 14, 2008, now Pat. No. 7,887,157.

(30) Foreign Application Priority Data

Oct. 16, 2007 (JP) ..... 2007-268756

(51) Int. Cl.
*B41J 2/165* (2006.01)

(52) U.S. Cl. ..... 347/33; 347/21; 347/29

(58) Field of Classification Search ..... 347/14, 347/20, 21, 22, 23, 28, 29, 30–37, 40, 42, 347/84, 89, 90
See application file for complete search history.

(56) References Cited

U.S. PATENT DOCUMENTS

| | | | | |
|---|---|---|---|---|
| 5,552,811 | A * | 9/1996 | Kurata et al. | 347/28 |
| 5,663,751 | A | 9/1997 | Holbrook | |
| 5,896,143 | A | 4/1999 | Matsui et al. | |
| 7,753,474 | B2 | 7/2010 | Hiruma | |

FOREIGN PATENT DOCUMENTS

| | | |
|---|---|---|
| JP | 2003-334962 | 11/2003 |
| JP | 2003-334962 A | 11/2003 |
| JP | 2004-255638 A | 9/2004 |
| JP | 2007-245136 A | 9/2007 |

* cited by examiner

*Primary Examiner* — Thinh Nguyen
(74) *Attorney, Agent, or Firm* — Workman Nydegger

(57) ABSTRACT

There is provided a fluid ejection apparatus for ejecting a fluid including a head for ejecting the fluid and a moisture retention head cap device for retaining moisture of the head. The moisture retention head cap device is disposed so as to surround a periphery of the head to cover the whole of the head when retaining moisture of the head.

8 Claims, 10 Drawing Sheets

SIXTH EMBODIMENT

<POWER SOURCE OFF STATE>

FIRST EMBODIMENT

<RIGHT AFTER ARRIVING AT HOME POSITION>

FIRST EMBODIMENT

<POWER SOURCE OFF STATE>

SECOND EMBODIMENT

<POWER SOURCE OFF STATE>

THIRD EMBODIMENT

<POWER SOURCE OFF STATE>

FOURTH EMBODIMENT

<POWER SOURCE OFF STATE>

FIFTH EMBODIMENT

<POWER SOURCE OFF STATE>

SIXTH EMBODIMENT

<RIGHT AFTER ARRIVING AT HOME POSITION>

SIXTH EMBODIMENT

<POWER SOURCE OFF STATE>

SIXTH EMBODIMENT

<WHEN PERFORMING SUCTION RECOVERY PROCESSING>

FLUID EJECTION APPARATUS

CROSS-REFERENCE TO RELATED APPLICATIONS

This application is a continuation of U.S. application Ser. No. 12/250,674 filed Oct. 14, 2008, which claimed priority to Japanese Patent Applications No. 2007-268756, filed on Oct. 16, 2007, the entire contents of which are incorporated herein by reference.

BACKGROUND

1. Technical Field

The present invention relates to a technique for eliminating clogging of a nozzle in a liquid ejection apparatus for ejecting fluid.

2. Related Art

In an ink jet type recording apparatus, ink is ejected on a recording paper or the like via a nozzle. Accordingly, there was a fear that ejection of ink can not be performed well due to clogging of the nozzle caused by increase of the viscosity of the ink near the nozzle or incorporation of bubbles in the nozzle. Consequently, an ink jet type recording apparatus that suctions and removes bubbles and viscosity increased ink remained in the nozzle by covering an ejection surface of the head with a dedicated cap and applying a negative pressure in the cap (hereinafter, referred to as "suction recovery processing") has been proposed (see JP-A-2003-334962).

In the aforementioned ink jet type recording apparatus, the ink ejected by the suction recovery processing may be adhered to the ejection surface of the head. Consequently, a wiper is provided near the dedicated cap and wiping the ink drop adhered to the ejection surface by scraping (wiping) the ejection surface with the wiper in some of the ink jet type recording apparatus. In such an ink jet recording apparatus, the ink wiped from the ejection surface when wiped may be adhered to the boundary portion between the ejection surface (nozzle plate) and a head side surface and to a head cover disposed at the boundary portion. In this case, the ink adhered to the head cover and the like is dried and the viscosity thereof is increased in, for example, a power source off state and a print standby state. As a result, there is a fear that the viscosity increased ink is adhered to the wiper when wiped at the next time and the viscosity increased ink is applied on the ejection surface. In this case, the nozzle on which the viscosity increased ink is applied may be clogged to cause ejection error of ink.

Note that the aforementioned problem may also occur in an ink jet type recording apparatus that is not equipped with a wiper. For example, in the case where a printing paper is made contact with the ejection surface of the head due to curling or folding of the printing paper, there is a fear that the viscosity increased ink adhered to a head cover and the like is applied on the ejection surface by the printing paper. Further, also in an ink jet type recording apparatus that performs so called flushing operation for removing viscosity increased ink and the like by ejecting a predetermined amount of ink from all of nozzles, the ink ejected by the flushing operation may be adhered to a head ejection surface to cause the aforementioned problem. That is, the aforementioned problem may occur in an ink jet type recording apparatus that performs a processing for ejecting ink from each nozzle separately from print processing (hereinafter, referred to as "preliminary ejection process"). Further, the aforementioned problem may occur in not only the ink jet type recording apparatus, but also in a fluid ejection apparatus that ejects another fluid except ink (including liquid, liquid material in which particles of a functional material are dispersed, solid such as a powder that can be ejected as liquid).

SUMMARY

An advantage of some aspects of the invention is to provide a technique capable of restraining drying of fluid adhered to a head of a liquid ejection apparatus.

The invention is made to solve at least a part of the aforementioned problem, and the invention can be provided as embodiments or applications described below.

Application 1

According to an aspect of the invention, there is provided a fluid ejection apparatus for ejecting a fluid including a head for ejecting the fluid and a moisture retention head cap device for retaining moisture of the head. The moisture retention head cap device is disposed so as to surround a periphery of the head to cover the whole of the head when retaining moisture of the head.

In the liquid ejection apparatus according to the application 1, the moisture retention head cap device is disposed so as to surround a periphery of the head to cover the whole of the head when retaining moisture of the head. Accordingly, drying of the fluid adhered to the head can be restrained.

Application 2

It is preferable that a carriage for holding the head is further included and that a sealing member is provided on at least a bottom surface of the carriage and the moisture retention head cap device, and the moisture retention head cap device is made contact with an area outside the area on which the head is disposed among the bottom surface of the carriage via the sealing member to surround the periphery of the head in the fluid ejection apparatus according to the application 1.

Herewith, the head can be disposed in the space surrounded by the bottom surface of the carriage, the sealing member, and the moisture retention head cap device. Accordingly, drying of the fluid adhered to the head can be restrained.

Application 3

It is preferable to further include a wiper for wiping the fluid adhered to an ejection surface of the head, and a wiper moisture retention unit for retaining moisture of the wiper in the fluid ejection apparatus according to the application 1 or application 2.

Herewith, drying of the fluid adhere to the wiper when wiping the fluid adhered to an ejection surface can be restrained. Accordingly, it can be restrained that the fluid adhered to the wiper is dried and the ink is applied on the ejection surface of the head when pining at the next time.

Application 4

It is preferable that the wiper moisture retention unit is (i) equipped with a wiper enclosure portion for surrounding a periphery of the wiper, and (ii) disposed so that the wiper enclosure portion is made contact with a bottom surface of the moisture retention head cap device when retaining moisture of the wiper in the fluid ejection apparatus according to the application 3.

Herewith, the wiper can be disposed in the space surrounded by the enclosure portion and the moisture retention head cap device. Accordingly, drying of the fluid adhered to the wiper can be restrained.

Application 5

It is preferable to further include a preliminary ejection head cap device for receiving the fluid in a preliminary ejection processing for ejecting the fluid that is separate from a valid ejection processing for ejecting the fluid toward a target to be processed disposed at a predetermined position, and a preliminary ejection head cap device moisture retention unit for retaining moisture of the preliminary ejection head cap device in the fluid ejection apparatus according to any one of the applications 1 to application 4.

Herewith, drying of the fluid adhered to the preliminary ejection head cap device when performing a preliminary ejection processing can be restrained. Accordingly, it can be restrained that the fluid adhered to the preliminary ejection head cap device is dried and adhered to the ejection surface of the head when performing the preliminary ejection processing at the next time.

Application 6

It is preferable that the preliminary ejection head cap device moisture retention unit is (i) equipped with a preliminary ejection head cap device enclosure portion for surrounding a periphery of the preliminary ejection head cap device, and (ii) disposed so that the preliminary ejection head cap device enclosure portion is made contact with a bottom surface of the moisture retention head cap device when retaining moisture of the preliminary ejection head cap device in the fluid ejection apparatus according to the application 5.

Herewith the preliminary ejection head cap device can be disposed in the space surrounded by the enclosure portion and the moisture retention head cap device. Accordingly, drying of the fluid adhered to the preliminary ejection head cap device can be restrained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described based on embodiments in the following order.

A. First Embodiment:
B. Second Embodiment:
C. Third Embodiment:
D. Fourth Embodiment:
E. Fifth Embodiment:
F. Sixth Embodiment:

A. First Embodiment

Figure 1:
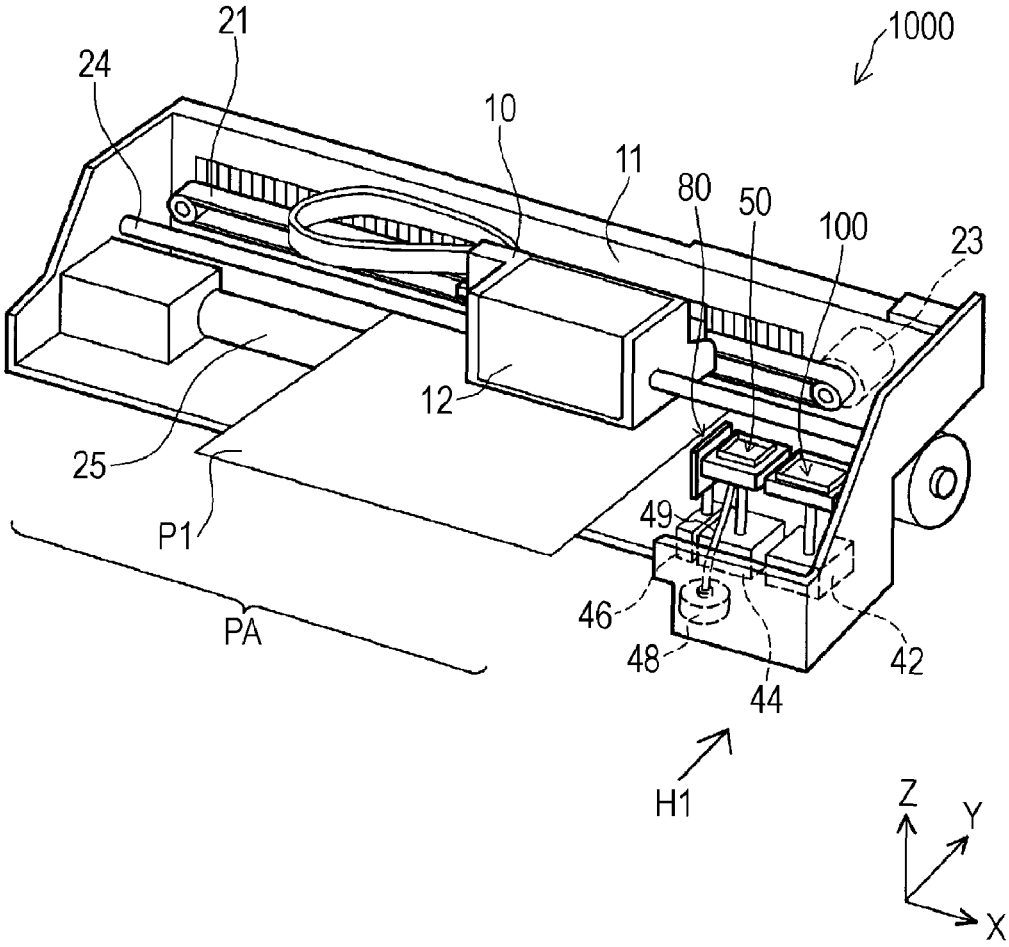
FIG. 1 is an illustrative diagram schematically showing a configuration of an ink jet type printer which is a fluid ejection apparatus as an embodiment of the invention.

FIG. 1 is an illustrative diagram schematically showing a configuration of an ink jet type printer which is a fluid ejection apparatus as an embodiment of the invention. A printer 1000 includes a frame 11, and a platen 25 is disposed to the frame 11. A printing paper P1 is to be transported on the platen 25 by a paper feeding mechanism not shown. Further, the printer 1000 includes a carriage 10, and the carriage 10 is supported so as to be able to be moved in a longitudinal direction (X axis direction) of the platen 25 via a guide member 24, and is reciprocated by a carriage motor 23 via a timing belt 21.

An ink cartridge 12 is mounted on the carriage 10. Further, an ink jet type recording head (hereinafter, simply referred to as "head") not shown is mounted at a bottom of the carriage 10. The carriage 10 is moved along the platen 25 to transport the head (omitted in FIG. 1) so as to be reciprocated on the printing paper P1. At this time, ink is ejected from the head (omitted in FIG. 1) and print processing is performed. Note that the print processing corresponding to the valid ejection processing in Claims. Further, besides the print processing, a process for suctioning each nozzle (suction recovery processing) is performed in the printer 1000 in order to remove bubbles and viscosity increased ink remained in each nozzle (omitted in FIG. 1). The suction recovery processing corresponds to the preliminary ejection processing in Claims.

In the frame 11, a non-print area in which no ink is ejected exists beside an area PA in which ink can be ejected from the head (omitted in FIG. 1). A home position H1 is provided in the non-print area. The carriage 10 is capable of moving between the print area PA and the home position H1.

A suction recovery cap device 50, a moisture retention cap device 100, a wiper 80, a suction pump 48, a tube 49, and three elevator means 42, 44, and 46 are disposed near the home position H1. The suction recovery cap device 50 receives ink and the like suctioned from the head (omitted in FIG. 1) when performing suction recovery processing. The suction pump 48 applies a negative pressure to an inner portion of the suction recovery cap device 50 in the suction recovery processing. The moisture retention cap device 100 is disposed to cover an ejection surface of the head (omitted in FIG. 1) in a power source off state for the reason described below. There is a case that an ink drop is adhered to the ejection surface of the head (omitted in FIG. 1) to remain thereon after print processing or the like. In this case, if the ink adhered to the ejection surface is dried and the viscosity of the ink is increased, a nozzle hole may be clogged to cause ejection error. Consequently, in order to prevent drying of the ink adhered to the ejection surface, the head (omitted in FIG. 1) is to be covered by the moisture retention cap device 100 when power source is off. Note that the suction recovery cap device 50 corresponds to the preparatory ejection head cap device in Claims.

The elevator means is capable of moving the moisture retention cap device 100 up and down. Similarly, the elevator means 44 and the elevator means 46 are capable of moving the suction recovery cap device 50 and the wiper 80 up and down respectively. Not that as for the three elevator means 42, 44, and 46, a known elevator mechanism such as a mechanism in which a motor and a screw are combined may be used.

Figure 2:
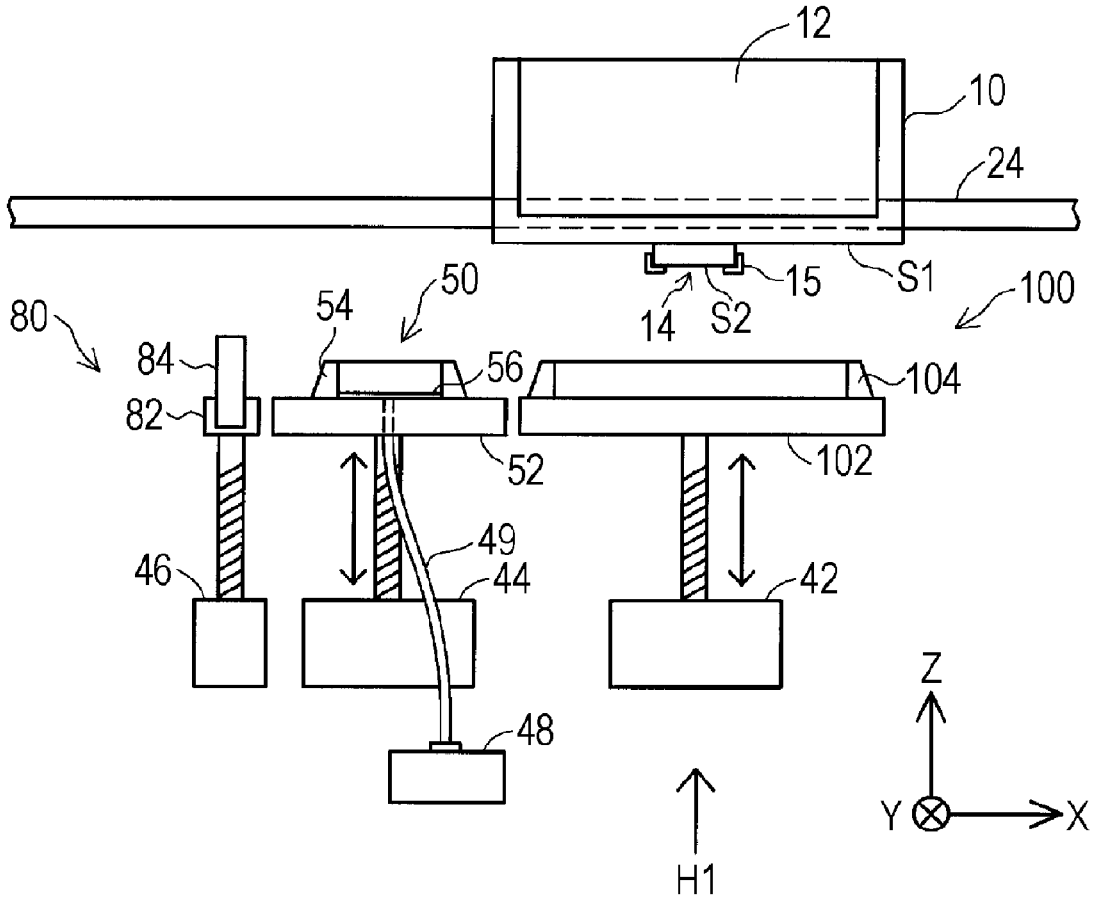
FIG. 2 is an illustrative diagram showing a detailed configuration near a home position right after a carriage is arrived at the home position.

FIG. 2 is an illustrative diagram showing a detailed configuration near the home position H1 right after the carriage 10 is arrived at the home position H1. A head 14 protruded in the −Z direction is disposed on a bottom surface S1 of the carriage 10. A head cover 15 is disposed to surround an ejection surface S2 of ink for the head 14. The head cover 15 serves to prevent that, for example, a nozzle plate not shown is peeled off and a folded printing paper is directly made contact with the head.

The moisture retention cap device 100 is equipped with a cap holder 102, a cap portion 104 disposed on the cap holder 102 to protrude in the +Z direction. The cap portion 104 may be constituted by an elastic member such as a synthetic gum. Note that the cap portion 104 corresponds to the sealing member in Claims.

The suction recovery cap device 50 is equipped with a cap holder 52, a cap portion 54 disposed on the cap holder 52 to protrude in the +Z direction, and a sheet-like sponge 56 disposed at the bottom of the space surrounded by the cap portion 54. The cap portion 54 may be constituted by an elastic member such as a synthetic gum similarly to the cap portion 104. The sponge 56 is connected to the suction pump 48 via the tube 49 that passes through the cap holder 52. The sponge 56 absorbs the remained ink forcibly discharged from the nozzle (omitted in FIG. 2) of the head 14 in the suction recovery processing. Note that the carriage 10 is disposed above the suction recovery cap device 50 and that the suction recovery cap device 50 is disposed to cover the head 14 from the lower direction in the suction recovery processing.

The wiper 80 is equipped with a support member 82 and a wiping portion 54 disposed on the support member 82. The wiping portion 84 may be constituted by a synthetic gum, and removes the ink remained on the ejection surface S2 by scraping the ejection surface S2 of the head 14. Note that the wiper 80 is disposed at the upper direction than the position shown in FIG. 2 when wiping the ink. Then, when the carriage 10 passes through the upper direction of the wiper 80, the ejection surface S2 of the head 14 is scraped by the wiping portion 84 to wipe the ink from the ejection surface S2.

When print processing is performed by the printer 1000 (FIG. 1), and printing is finished, the carriage (FIG. 2) returns to the home position H1. Then, the carriage 10 is disposed so that the head 14 is positioned just above the moisture retention cap device 100. Note that the carriage 10 is disposed at the same position as the position shown in FIG. 2 even just before the power source of the printer 1000 is turned on and print processing is started.

Figure 3:
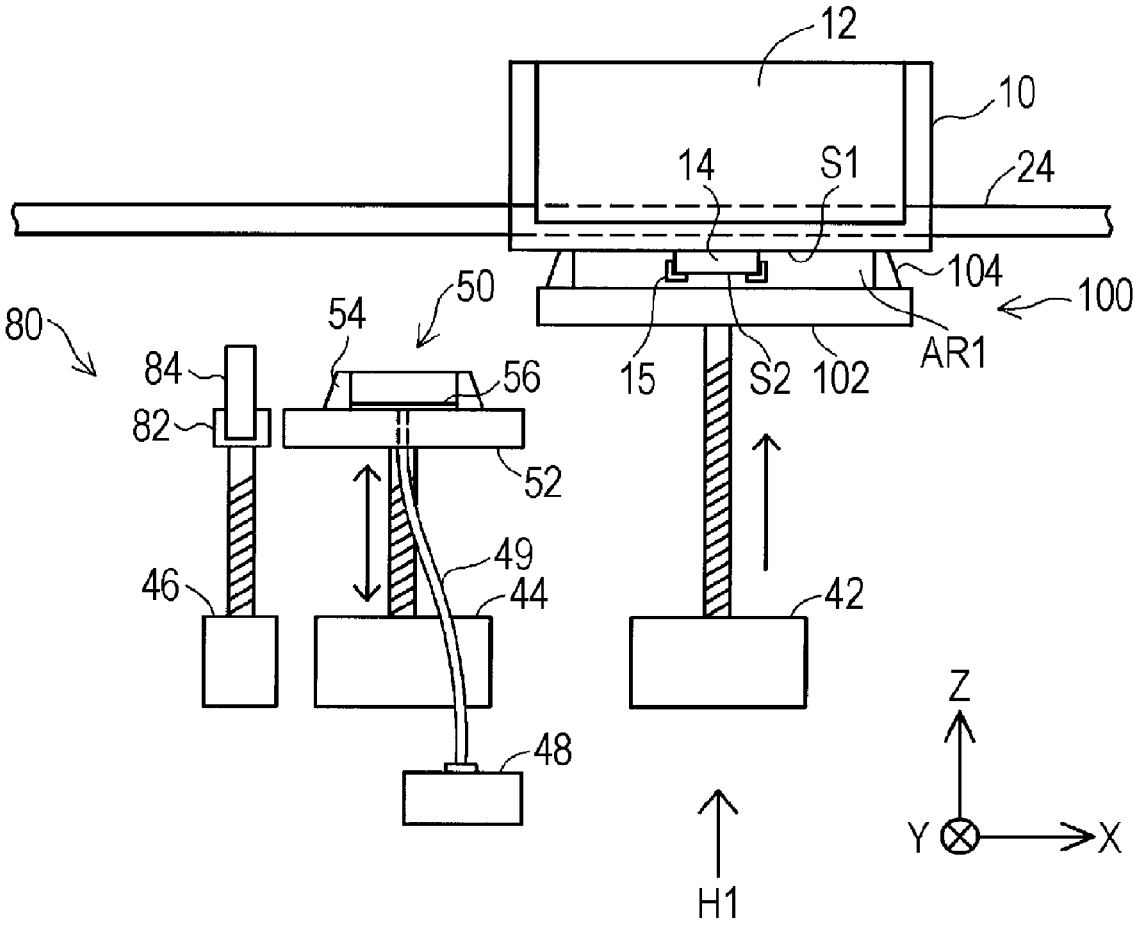
FIG. 3 is an illustrative diagram showing a detailed configuration near the home position in a power source off state.

FIG. 3 is an illustrative diagram showing a detailed configuration near the home position H1 in a power source off state. The carriage 10 is disposed at the home position H1 when the power source of the printer 1000 is off. Note that also in a power source on state, the carriage 10 is disposed at the same position as the position shown in FIG. 4 when print processing and flushing processing are not performed (standby state).

For example, when carriage 10 is returned to the home position H1 after printing is finished (see FIG. 2), and transited to a standby state, the elevator means 42 raises the moisture retention cap device 100. Consequently, the cap portion 104 of the moisture retention cap device 100 is made contact with a portion of the bottom surface S1 of the carriage 10 outside the head 14, and the moisture retention cap device 100 is disposed so as to surround the periphery of the head 14 to cover the whole of the head 14. At this time, an approximately sealed space AR1 surrounded by the cap portion 104 and the bottom surface S1 of the carriage 10 is formed. Then, the entire head 14 (the head 14 and the head cover 15) is disposed in the space AR1. Accordingly, it can be restrained that the ink adhered to the ejection surface S2 of the head and the head cover 15 is dried.

As described above, in the first embodiment, the moisture retention cap device 100 is disposed so as to surround the periphery of the head 14 to cover the whole of the head 14 in a power source off state. Accordingly, not only drying of the ink adhered to the head 14 can be restrained, but also drying of the ink adhered to the head cover 15 can be restrained.

B. Second Embodiment B

Figure 4A:
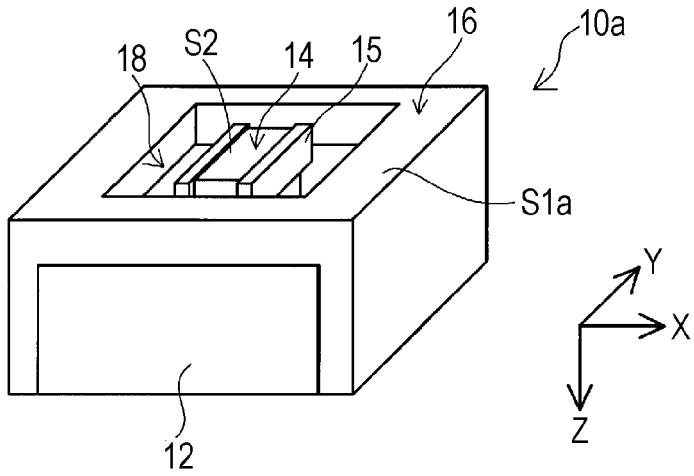
FIG. 4A is an illustrative diagram showing a detailed configuration of a carriage and a head in a second embodiment.
Figure 4B:
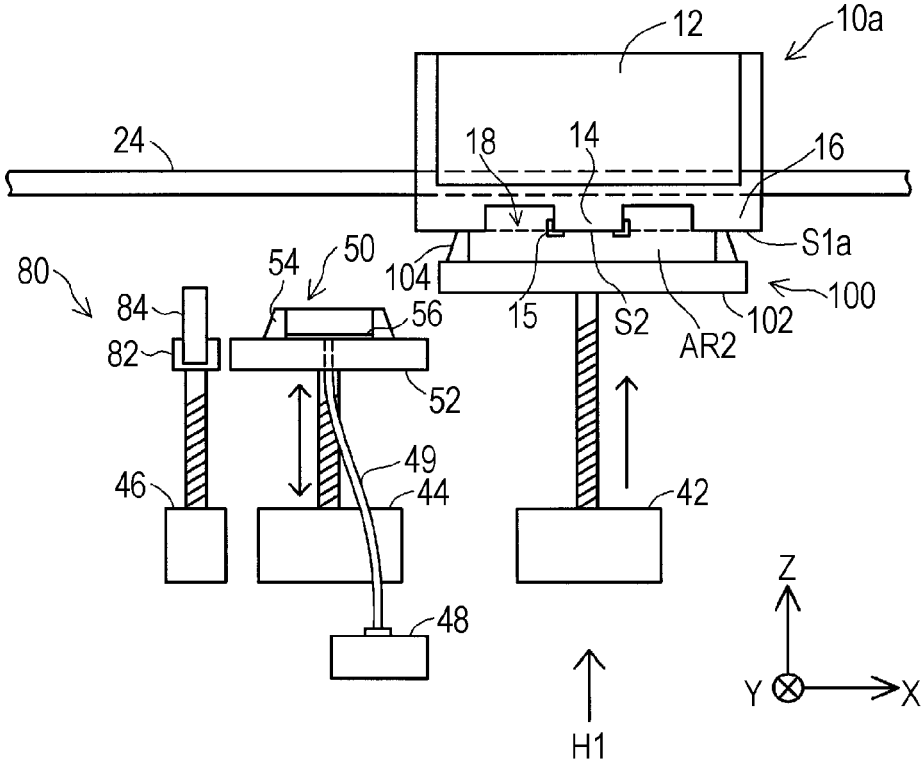
FIG. 4B is an illustrative diagram showing a detailed configuration near the home position in the second embodiment.

FIG. 4A is an illustrative diagram showing a detailed configuration of a carriage and a head according to the second embodiment. FIG. 4B is an illustrative diagram showing a detailed configuration near the home position H1 according to the second embodiment. Note that, in FIG. 4A, the carriage and the head are shown when viewed from the bottom direction of the carriage. Further, in FIG. 4B, a configuration near the home position H1 in a power source off state is shown.

In the printer of the second embodiment, the height of the bottom surface of the carriage and the height of the ejection surface of the head are the same. This is the point that is different from the printer 1000 (FIGS. 1 to 3). The other configuration is the same as that of the first embodiment. Specifically, the printer of the second embodiment is equipped whit a concave part 18 and a convex part 16 surrounding the concave part 18 on a bottom surface S1*a* of a carriage 10*a* (FIG. 4A). The head 14 is disposed in the concave part 18. Note that the head 14 and the head cover 15 are the same as the head 14 and the head cover 15 of the first embodiment. Herein, the height (height in Z axis direction) of the convex part 16 and the height of the head 14 are the same.

In a power source off state (FIG. 4B), the cap portion 104 of the moisture retention cap device 100 is made contact with the bottom surface S1*a* of the carriage 10*a* similarly to the first embodiment. At this time, the cap portion 104 is made contact with the bottom surface S1*a* of the carriage 10*a* at the convex part 16. Herein, since the height of the head 14 and the height of the convex part 16 are the same, the height of the ejection surface of the head 14 and the height of the bottom surface S1*a* of the carriage 10*a* are the same.

With the above configuration, the moisture retention cap device 100 is also disposed so as to surround the periphery of the head 14 to cover the whole of the head 14. Accordingly, the printer according to the second embodiment has the same effect as that obtained by the printer 1000 according to the first embodiment.

C. Third Embodiment

Figure 5:
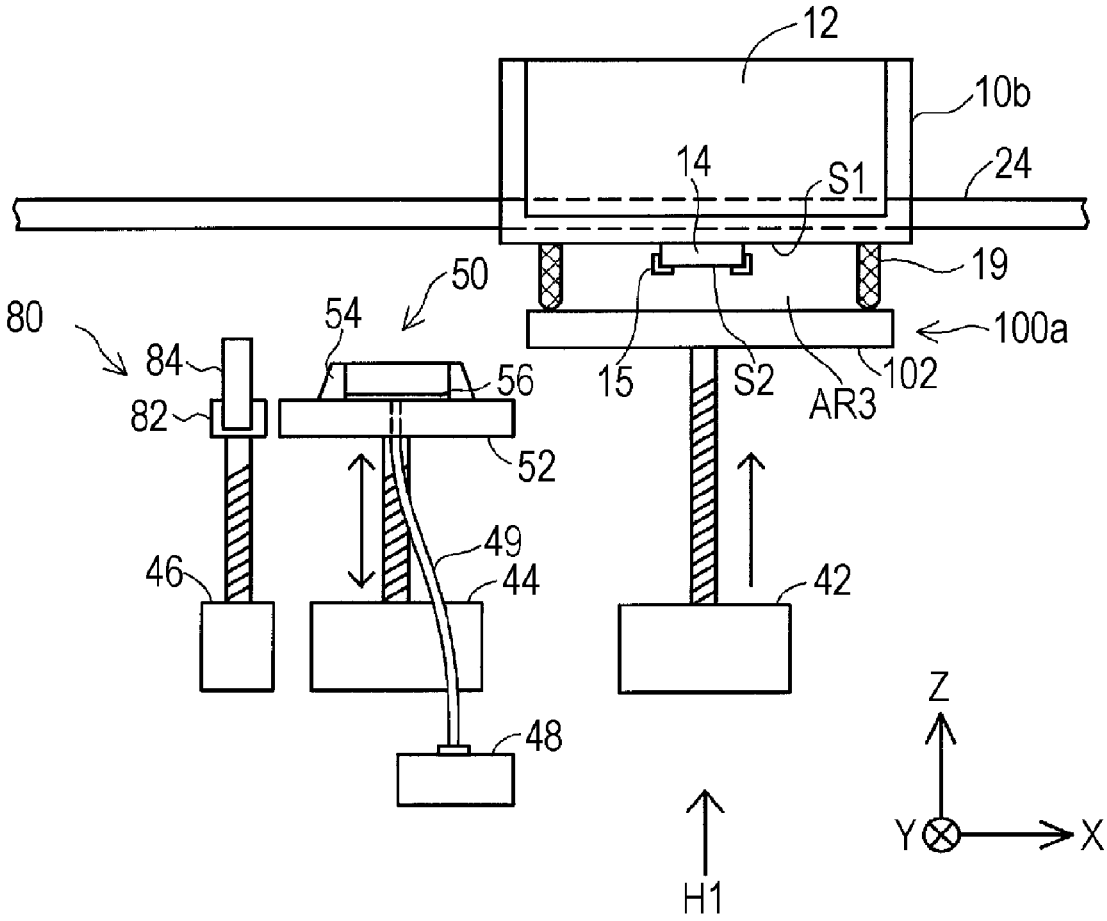
FIG. 5 is an illustrative diagram showing a detailed configuration near the home position in a third embodiment.

FIG. 5 is an illustrative diagram showing a detailed configuration near the home position H1 according to the third embodiment. In FIG. 5, a configuration near the home position H1 in a power source off state is shown. In a printer according to the third embodiment, a sealing portion is equipped on a bottom surface of the carriage and the moisture retention cap device is equipped with no cap portion. These points are different from the printer 1000 (FIGS. 1 to 3). Other configuration is the same as that of the first embodiment.

Specifically, the cap portion 104 is not disposed on the cap holder 102 in a moisture retention cap device 100*a* different from the moisture retention cap device 100 (FIG. 2). Further, a sealing portion 19 is disposed to surround the head 14 on the bottom surface S1 in a carriage 10*b* according to the third embodiment. The sealing portion 19 is constituted by, for example, an elastic member such as a synthesis gum. Then, in a power source off state, the carriage 10*b* is disposed at the home portion H1, and the elevator means 42 raises the moisture retention cap device 100*a*. Consequently, the cap holder 102 is made contact with the sealing portion 19, and an approximately sealed space AR3 surrounded by the bottom surface S1 of the carriage 10*b*, the sealing portion 19, and the cap holder 102 is formed.

Since the head 14 and the head cover 15 are disposed in the space AR3, the printer according to the third embodiment has the same effect as that obtained by the printer 1000 according to the first embodiment. In the third embodiment, the moisture retention cap device 100*a* is equipped with no cap portion 104. Alternatively, a configuration may be employed in which the cap portion 104 is equipped similarly to the first embodiment. Also with the configuration, the sealing portion 19 and the cap portion 104 can be made contact to each other to form an approximately sealed space, and the head 14 and the head cover 15 can be disposed in the space.

D. Fourth Embodiment

Figure 6:
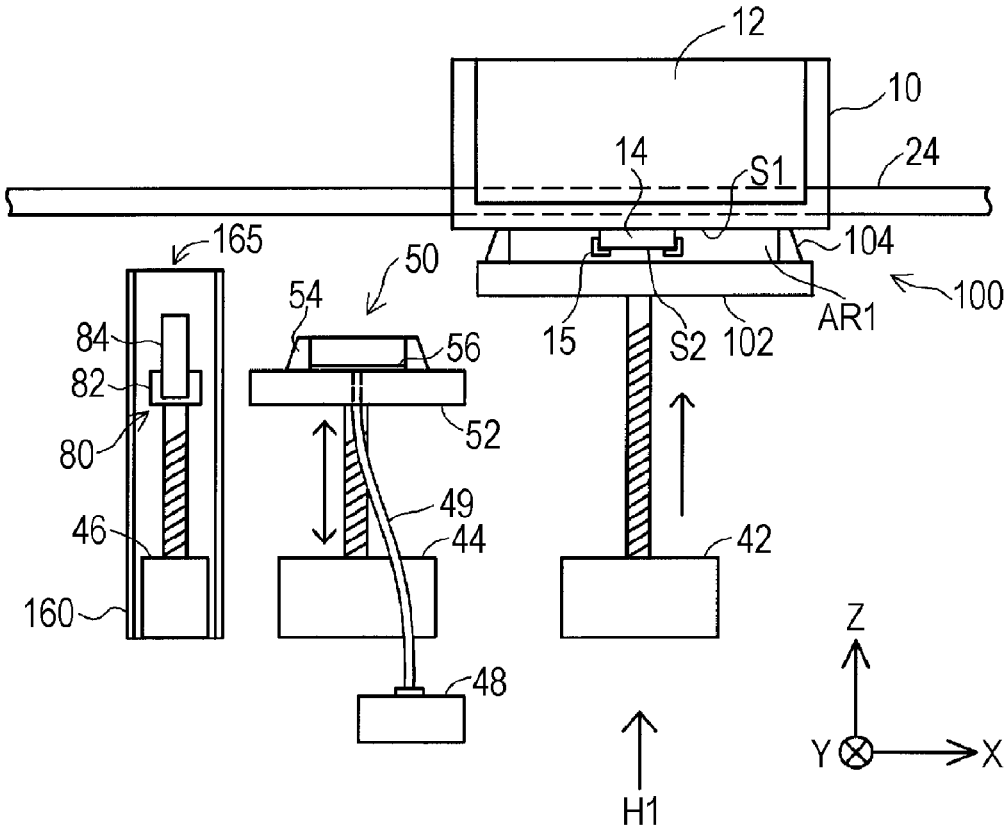
FIG. 6 is an illustrative diagram showing a detailed configuration near the home position in a forth embodiment.

FIG. 6 is an illustrative diagram showing a detailed configuration near the home position H1 according to the fourth embodiment. In FIG. 6, a configuration near the home position H1 in a power source off state is shown. A printer of the fourth embodiment is capable of retaining moisture of the wiper 80 in a power source off state. This is the point different from the printer 1000 (FIGS. 1 to 3). Other configuration is the same as that of the first embodiment.

Specifically, the printer of the fourth embodiment is equipped with a hollow enclosure portion 160 disposed to surround the wiper 80 and the elevator means 46. In a power source off state, the wiper 80 is stored in the hollow portion in the enclosure portion 160. Then, when wiping is performed, the wiper 80 is protruded from an opening 165 provided at the upper portion of the enclosure portion 160, and the wiper 80 wipes the ink by scraping the ejection surface S2 of the head 14 being moved in the X direction. Note that the enclosure portion 160 may be disposed so that only the wiper 80 is surrounded and the elevator means 46 is not surrounded. Note that the enclosure portion 160 corresponds to the wiper moisture retention unit of Claims.

In the above configuration, the wiper 80 is stored in the enclosure portion 160 in a power source off state. Accordingly, drying of the ink adhered to the wiper can be restrained as compared to the configuration in which the wiper 80 is perfectively exposed. Further, in a power source off state, the head 14 and the head cover 15 are covered with the moisture retention cap device 100. Accordingly, the printer according to the fourth embodiment has the same effect as that obtained by the printer 1000 according to the first embodiment.

E. Fifth Embodiment

Figure 7:
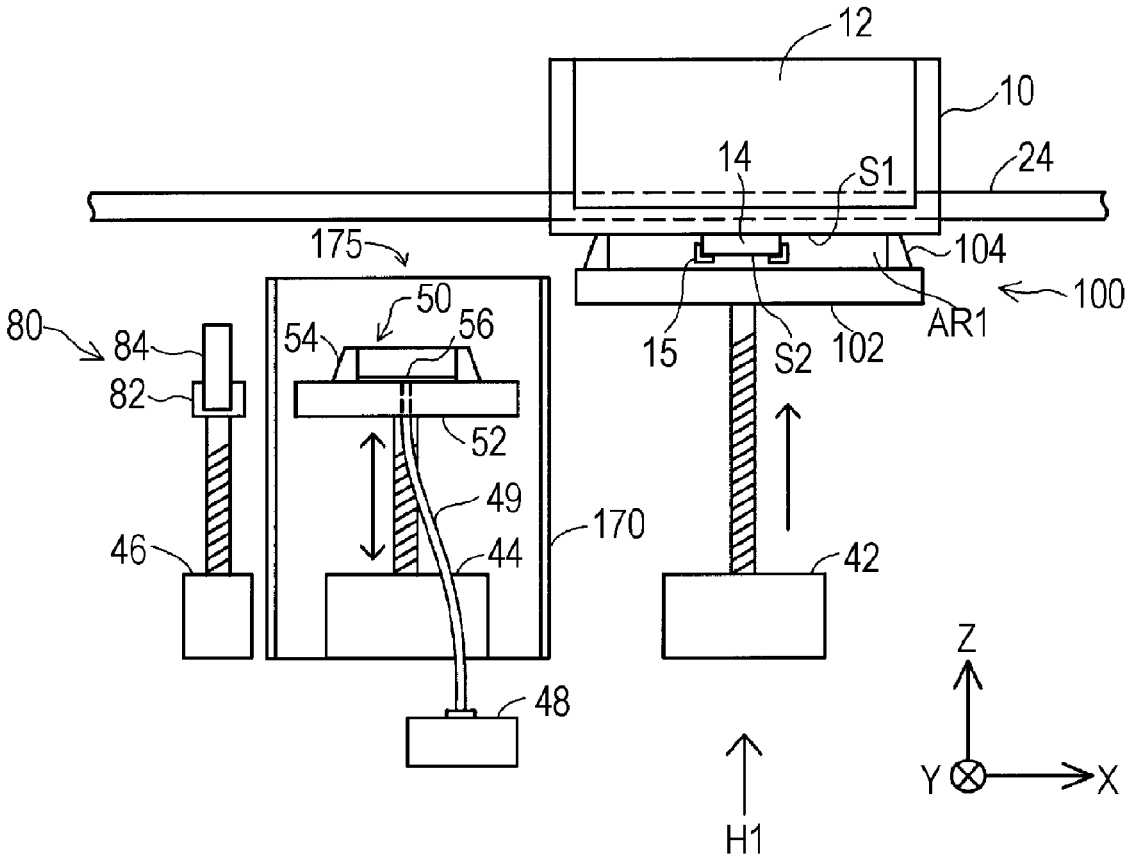
FIG. 7 is an illustrative diagram showing a detailed configuration near the home position in a fifth embodiment.

FIG. 7 is an illustrative diagram showing a detailed configuration near the home position H1 according to the fifth embodiment. In FIG. 7, a configuration near the home position H1 in a power source off state is shown. A printer according to the fifth embodiment is capable of retaining moisture of the suction recovery cap device 50 instead of the wiper 80 in a power source off state. This is a point different from the printer according to the fourth embodiment. Other configuration is the same as that of the forth embodiment.

Specifically, the printer according to the fifth embodiment is equipped with a hollow enclosure portion 170 disposed to surround the suction recovery cap device 50 and the elevator means 44. In a power source off state, the suction recovery cap device 50 is stored in the hollow enclosure portion 170. Then, when suction recovery processing is performed, the suction recovery cap device 50 is protruded from an opening 175 provided at the upper portion of the enclosure portion 170 to make contact with the bottom surface S1 of the moisture retention cap device 100. Note that the enclosure portion 170 may be disposed so that only the suction recovery cap device 50 is surrounded and the elevator means 44 is not surrounded. Note that the enclosure portion 170 corresponds to preliminary ejection head cap device moisture retention unit of Claims.

According to the configuration, the suction recovery cap device 50 is stored in the enclosure portion 170 in a power source off state, so that drying of the ink adhered to the suction recovery cap device 50 can be restrained as compared to the configuration in which the suction recovery cap device 50 is perfectively exposed. Further, in a power source off state, the head 14 and the head cover 15 are covered with the moisture retention cap device 100, so that the printer according to the fifth embodiment has the same effect as that obtained by the printer according to the fourth embodiment.

F. Sixth Embodiment

Figure 8:
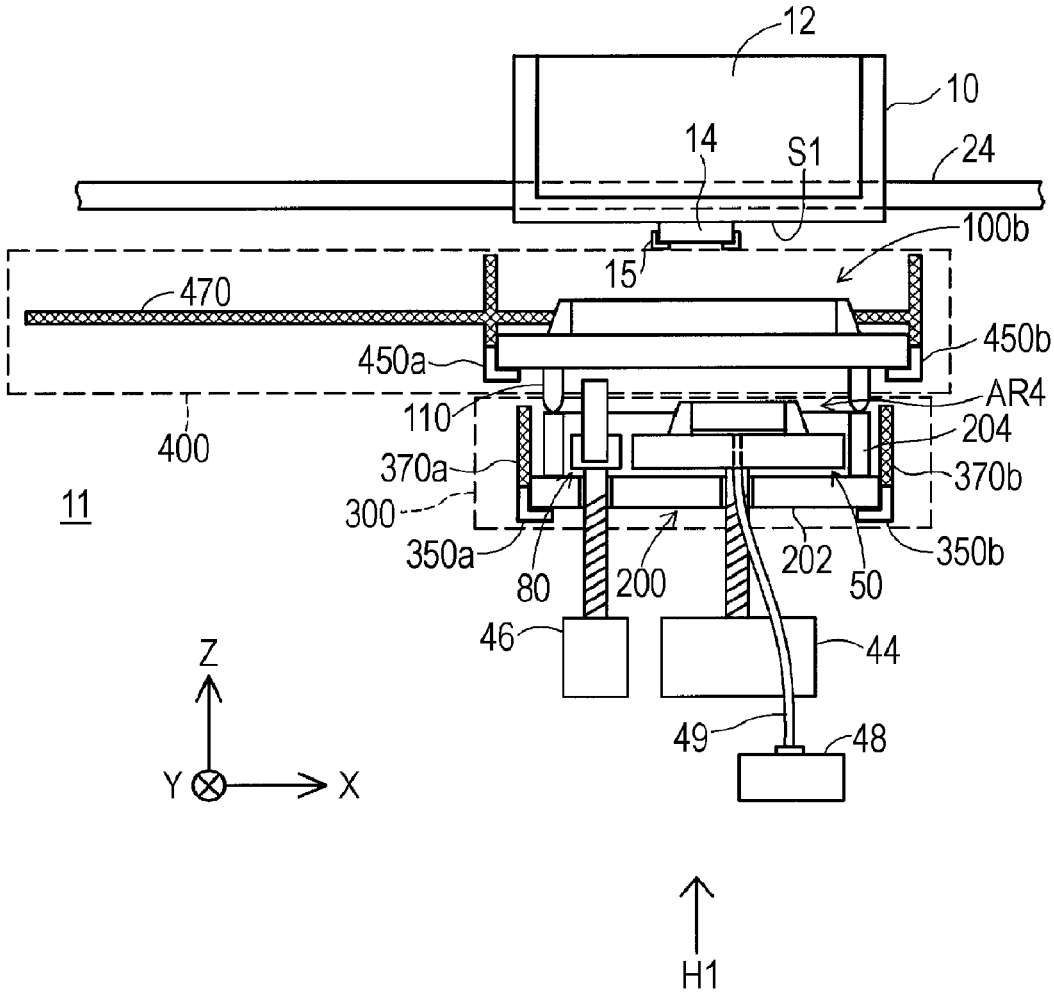
FIG. 8 is an illustrative diagram showing a detailed configuration near the home position in a sixth embodiment.

FIG. 8 is an illustrative diagram showing a detailed configuration near the home position H1 according to the sixth embodiment. In FIG. 8, a configuration near the home position H1 right after the carriage 10 is arrived at the home position H1 is shown. In a printer according to the sixth embodiment, the wiper 80 and the suction recovery cap device 50 are disposed in an approximately sealed space and the moisture is retained in a power source off state. This is a point different from the printer 1000 (FIGS. 1 to 3). The other configuration is the same as that of the first embodiment.

Specifically, the printer according to the sixth embodiment is equipped with no elevator means 42 different from the printer 1000 (FIGS. 1 to 3). Further, different from the printer 1000, the printer according to the sixth embodiment is equipped with a cap device 200 for covering the wiper 80 and the suction recovery cap device 50, a moving mechanism 300 for moving the cap device 200 up and down, and a moving mechanism 400 for moving a moisture retention cap device 100*b* up and down and right and left.

A sealing portion 110 is disposed at a bottom surface of the moisture retention cap device 100*b* to surround a predetermined area. The moisture retention cap device 100*b* is supported by two support members 450*a*, 450*b* from the lower direction. The two support members 450*a*, 450*b* are connected to the moving mechanism 400 via a slide hole 470 provided in the frame 11, and the moving mechanism 400 can move the moisture retention cap device 100*b* up and down and left and right by sliding the two support members 450*a*, 450*b* up and down and left and right. Note that the moving mechanism 400 is disposed behind the slide hole 470 (outside the frame 11).

The cap device 200 is equipped with a support member 202, an enclosure portion 204 disposed on the support member 200 and protruded in the +Z direction. The enclosure portion 204 is disposed to surround the wiper 80 and the suction recovery cap device 50. Note that the suction recovery cap device 50 and the elevator means 44 are connected via the support member 202, and similarly, the wiper 80 and the elevator means 46 are connected via the support member 202. The cap device 200 is supported by two support members 350*a*, 350*b* from the lower direction. The support member 350*a* is connected to the moving mechanism 300 via a slide hole 370*a* provided in the frame 11. Similarly, the support member 350*b* is connected to the moving mechanism 300 via a slide hole 370*b* provided in the frame 11. Then, the moving mechanism 300 is capable of moving the cap device 200 up and down by sliding the two support members 350*a*, 350*b* up and down. Note that the moving mechanism 300 is disposed behind the slide holes 370*a*, 370*b* similarly to the moving mechanism 400.

Right after the carriage 100 is arrived at the home position H1, the enclosure portion 204 of the cap device 200 is made contact with the sealing portion 110 of the moisture retention cap device 100*b*. Then, an approximately sealed space AR4 surrounded by the bottom surface of the moisture retention cap device 100*b*, the sealing portion 110, the enclosure portion 204, and the support member 202 is formed. The wiper 80 and the suction recovery cap device 50 are disposed in the space AR4. At this time, the moisture retention cap device 100*b* and the cap device 200 are disposed at the lowest position. Note that the cap device 200 corresponds to the wiper moisture retention unit and the preliminarily ejection head cap device moisture retention unit of Claims.

Figure 9:
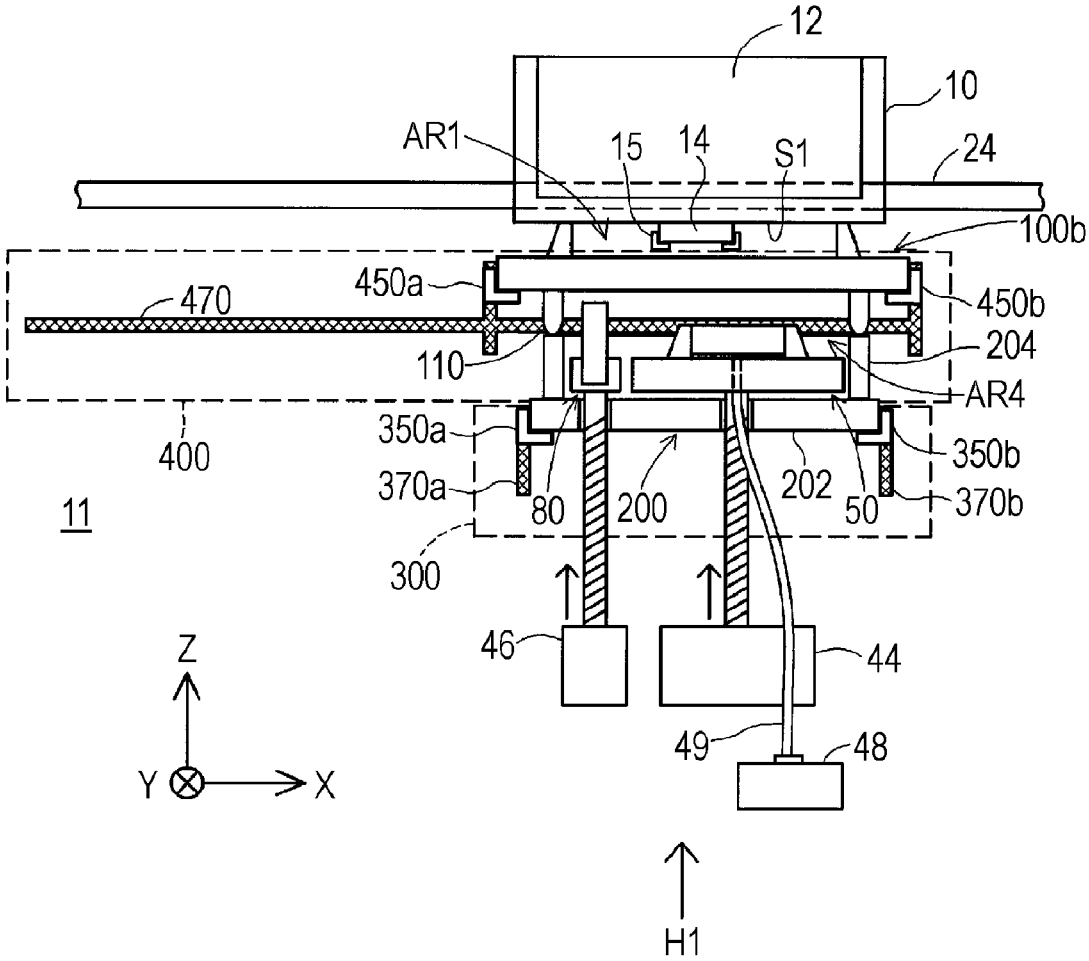
FIG. 9 is an illustrative diagram showing a detailed configuration near the home position in a power source off state in the sixth embodiment.

FIG. 9 is an illustrative diagram showing a detailed configuration near the home position H1 in a power source off state according to the sixth embodiment. Not that the configuration is the same as the configuration shown in FIG. 9 also in a standby state. When transited to a power source off state or a standby state, the moving mechanism 400 raises the moisture retention cap device 100*b* to make contact with the carriage 10 from the state shown in FIG. 8. At this time, the moving mechanism 300 raises the cap device 200 in synchronization with the raising speed of the moisture retention cap device 100*b*, and maintains the state in which the enclosure portion 204 is made contact with the sealing portion 110. Further, the elevator means 44 raises the suction recovery cap device 50 and the elevator means 46 raises the wiper 80 in synchronization with the raising speed of the cap device 200.

In this manner, when transited to a power source off state, the approximately sealed space AR1 surrounded by the bottom surface S1 of the carriage 10 and the moisture retention cap device 100*b* is to be newly formed in the state where the approximately sealed space AR4 surrounded by the moisture retention cap device 100*b* and the cap device 200 is formed. Then, the head 14 and the head cover 15 are disposed in the space AR1.

Figure 10:
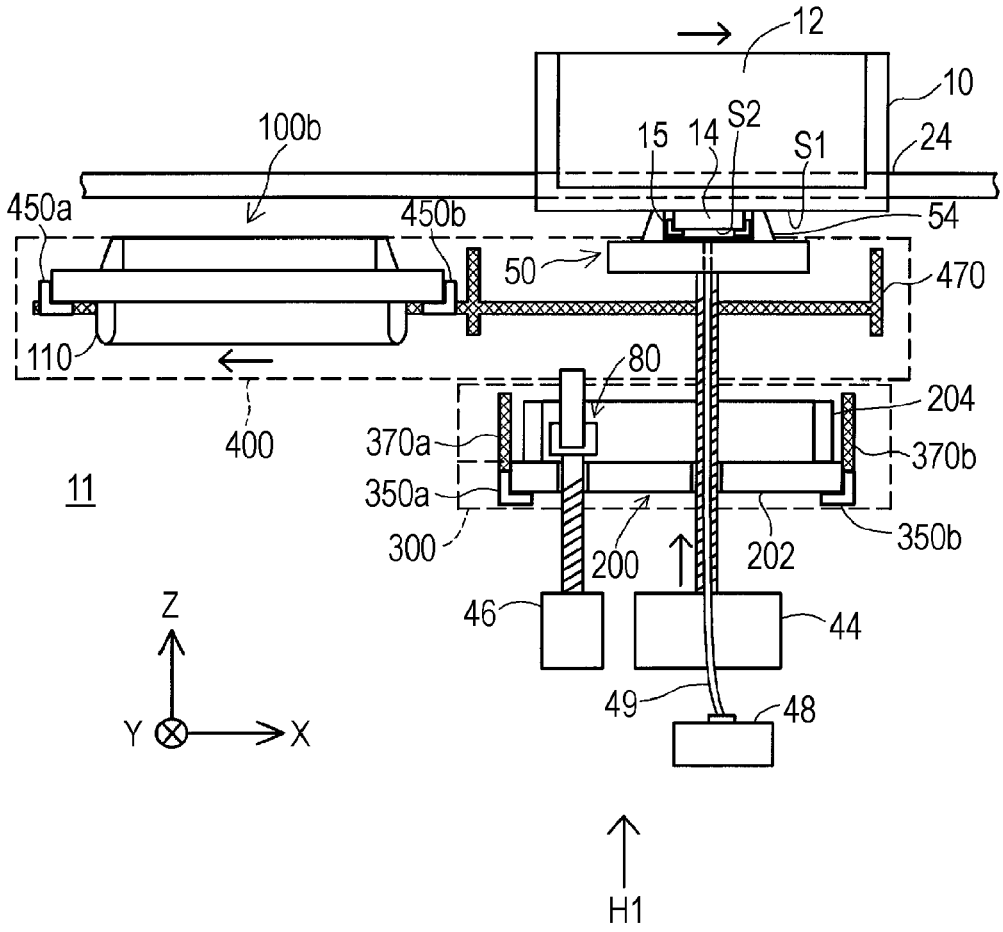
FIG. 10 is an illustrative diagram showing a detailed configuration near the home position when a suction recovery processing is performed in the sixth embodiment.

FIG. 10 is an illustrative diagram showing a detailed configuration near the home position H1 when the suction recovery processing is performed according to the sixth embodiment. For example, when suction recovery processing is performed after the carriage 10 is arrived at the home position (see FIG. 8), the carriage 10 is slightly moved to the right and is disposed above the suction recovery cap device 50. The moving mechanism 400 moves the moisture retention cap device 100*b* to the most left side. The elevator means 44 raises the suction recovery cap device 50 to be made contact with the bottom surface S1 of the carriage 10. Consequently, the suction recovery cap device 50 covers the head 14 and the head cover 15 and remained ink can be suctioned from the nozzle of the head 14 by the suction pump 48. Then, after the suction recovery processing is finished, the suction recovery cap device 50 and the like are disposed at a predetermined position of a power source off state (see FIG. 9). Herewith, drying of the ink adhered to the suction recovery cap device 50 in the suction recovery processing can be restrained. Note that the position with which the suction recovery cap device 50 (cap portion 54) is made contact when the suction recovery processing is performed may be the ejection surface S2 of the head 14 instead of the bottom surface S1 of the carriage 10. With the configuration, the space with which the nozzle hole (omitted in FIG. 10) is made contact becomes narrow to enhance airtightness, and more high moisture retention capability can be obtained. Further, with the configuration, it is prevented that ejected remained ink is spattered into a wide range. Accordingly, there is an effect that the ink can be more surely received with the sponge 56, or an effect obtained by applying a negative pressure can be more surely provided.

As described above, the printer according to the sixth embodiment is constituted so that the wiper 80 and the suction recovery cap device 50 are disposed in the approximately sealed space AR4 in a power source off state, so that it can be restrained that the ink adhered to the wiper 80 and the suction recovery cap device 50 is dried. Further, in a power source off state, the head 14 and the head cover 15 are covered with the moisture retention cap device 100*b*, so that the printer according to the sixth embodiment has the same effect as that obtained by the printer 1000 according to the first embodiment.

G. Modifications

Note that the elements except the elements claimed in the main claim among the constituent elements in the aforementioned each embodiment are additional elements and may be appropriately omitted. In addition, the invention is not limited to the aforementioned embodiments and may be performed in various embodiments without departing from the scope of the spirit. For example, modifications described below may be available.

G1. Modification 1

In the aforementioned each embodiment, drying of the ink adhered to the head 14 and the head cover 15 is restrained by disposing the head 14 and the head cover 15 in the approximately sealed space. However, in addition to the configuration, drying of ink may be restrained by humidifying the approximately sealed space. Specifically, moisture retention cap device 100, 100*a*, 100*b* may be connected to a tank in which water is stored with a tube or the like to send water vapor to the sealed space AR1, AR2, AR3 by heating the water tank with a heater. Further, in the fourth embodiment, a water tank may be connected to the enclosure portion 160 (FIG. 6) to humidify the inner hollow portion. Similarly, in the fifth embodiment, a water tank may be connected to the enclosure portion 170 (FIG. 7) to humidify the inner hollow portion. Further, in the sixth embodiment, a water tank may be connected to the cap device 200 (FIG. 9) to humidify the space AR4 together with the space AR1.

G2 Modification 2

In the aforementioned each embodiment, the number of the head disposed on the bottom surface S1 of the carriage 10 is one. Alternatively, a configuration may be employed in which a plurality of heads are disposed. In this case, the moisture retention cap device 100, 100*a*, 100*b* may cover the whole or a part of the plurality of heads in a power source off state. In the configuration in which a plurality of heads are provided, in the case where a plurality of suction recovery cap devices and a plurality of wipers are provided in order to perform suction recovery processing for each of the heads, the cap device 200 may cover the plurality of suction recovery devices and the plurality of wipers.

G3. Modification 3

In the aforementioned each embodiment, the suction recovery cap device 50 covers the both of the head 14 and the head cover 15. Alternatively, a configuration may be employed in which only an area in which nozzle ejection holes are provided among the ejection surface S2 of the head 14 is covered and the other area of the ejection surface S2 and the head cover 15 is not covered.

G4. Modification 4

In the aforementioned each embodiment, the suction recovery cap device 50 is provided. Alternatively, a flushing cap device (flushing box) may be provided instead of the suction recovery cap device 50 or together with the suction recovery cap device 50. In this case, like the fifth embodiment, an enclosure portion surrounding the flush cap device may be provided. Further in the sixth embodiment, instead of the suction recovery cap device 50 or together with the suction recovery cap device 50, the flush cap device may be covered with the cap device 200 with the wiper. Note that the flushing cap device (and suction recovery cap device 50) corresponds to the preliminary ejection head cap device of Claims in the aforementioned configuration.

G5. Modification 5

In the aforementioned each embodiment, the moisture retention cap device 100, 100*a*, 100*b* is made contact with the bottom surface S1 of the carriage 10, 10*a*, 10*b* in a power source off state. Alternatively, the moisture retention cap device 100, 100*a*, 100*b* may be disposed so as not to make contact with the bottom surface S1 and so that a small gap exists between with the bottom surface S1. With the configuration, drying of the ink adhered to the head 14 and the head cover 15 can be also restrained as compared with the case where the head 14 and the head cover 15 are perfectively exposed. That is, a configuration may be generally employed in which the entire head 14 is covered by surrounding the head 14 as the moisture retention cap device of the fluid ejection apparatus of the invention.

G6. Modification 6

In the third embodiment, the sealing portion 19 is provided on the bottom surface S1 of the carriage 10*b* (FIG. 5). The sealing portion 19 may be provided on the bottom surface of the carriage 10, 10*a* also in the second, fourth, fifth, and sixth embodiments. Further, the carriage 10*a* (FIG. 4) in the second embodiment may be applied to the third to sixth embodiments.

G7: Modification 7

In the aforementioned each embodiment, the head 14 is equipped with the head cover 15. However, it is not necessary to provide the head cover 15. With the configuration, the whole of the head 14 is also covered with the retention cap device 100, 100*a*, 100*b*. Accordingly, drying of the ink adhered to the border between a side surface and the ejection surface of the head 14 can be restrained.

G8. Modification 8

In the sixth embodiment, the cap device 200 surrounds the both of the wiper 80 and the suction recovery cap device 50. Alternatively, a cap device for covering the wiper 80 and a cap device for covering the suction recovery cap device 50 may be separately provided. In this case, the two cap devices may be made contact with the bottom surface of the moisture retention cap device 100*b* respectively to cover the wiper 80 and the suction recovery cap device 50.

G9. Modification 9

In the aforementioned each embodiment, the ink jet type printer is described. However, the invention is not limited to this and can be applied to any fluid ejection apparatus that ejects fluid except ink (including liquid, liquid material in which particles of a functional material are dispersed, solid that can be flowed and ejected as liquid). For example, the invention can be also applied to a granular material ejection apparatus that ejects a granular material containing a material such as an electrode material, a coloring material, and the like used for manufacturing a liquid crystal display, an EL (Electro Luminescence) display, a field emission display, and the like in the form of dispersion or dissolution. Further, the invention can be also applied to a liquid ejection apparatus for ejecting a bio-organic substance used for manufacturing a bio-chip, a liquid ejection apparatus for ejecting a liquid that becomes a specimen used as a precision pipette, a liquid ejection apparatus for ejecting grease to a precision instrument such as a watch, a camera, or the like, with pinpoint accuracy, a liquid ejection apparatus for ejecting a transparent resin liquid such as an ultraviolet cure resin on a substrate for forming a fine hemispherical lens (optical lens) used for an optical communication element or the like, and a liquid ejection apparatus for ejecting an etching liquid such as an acid, an alkali, or the like for etching a substrate.

What is claimed is:

1. Method of operating a fluid ejection apparatus for ejecting a fluid, comprising:

a head for ejecting the fluid;

a moisture retention head cap device for retaining moisture of the head;

a wiper for wiping the fluid adhered to an ejection surface of the head; and a wiper moisture retention unit for retaining moisture of the wiper, wherein the moisture retention head cap device is disposed so as to surround a periphery of the head to cover the whole of the head when retaining moisture of the head, and wherein the wiper moisture retention unit is (i) equipped with a wiper enclosure portion for surrounding a periphery of the wiper, and (ii) disposed so that the wiper enclosure portion is made contact with a bottom surface of the moisture retention head cap device when retaining moisture of the wiper, comprising steps of:

(i) step of forming first approximately sealed space between the moisture retention head cap device and the wiper moisture retention unit;

(ii) step of forming second approximately sealed space between the bottom surface of the carriage and the moisture retention head cap device, while maintaining the first approximately sealed space;

(iii) step of transiting to power-off state or waiting state.

2. Method of operating the fluid ejection apparatus for ejecting a fluid according to claim 1, further comprising:

a carriage for holding the head, wherein a sealing member is provided on at least a bottom surface of the carriage and the moisture retention head cap device, and the moisture retention head cap device is made contact with an area outside the area on which the head is disposed among the bottom surface of the carriage via the sealing member to surround the periphery of the head.

3. Method of operating the fluid ejection apparatus for ejecting a fluid according to claim 1, further comprising:

a preliminary ejection head cap device for receiving the fluid in a preliminary ejection processing for ejecting the fluid that is separate from a valid ejection processing for ejecting the fluid toward a target to be processed disposed at a predetermined position; and a preliminary ejection head cap device moisture retention unit for retaining moisture of the preliminary ejection head cap device.

4. Method of operating the fluid ejection apparatus for ejecting a fluid according to claim 3, wherein the preliminary ejection head cap device moisture retention unit is (i) equipped with a preliminary ejection head cap device enclosure portion for surrounding a periphery of the preliminary ejection head cap device, and (ii) disposed so that the preliminary ejection head cap device enclosure portion is made contact with a bottom surface of the moisture retention head cap device when retaining moisture of the preliminary ejection head cap device.

5. Method of operating a fluid ejection apparatus for ejecting a fluid, comprising:

a head for ejecting the fluid;

a moisture retention head cap device for retaining moisture of the head;

a preliminary ejection head cap device for receiving the fluid in a preliminary ejection processing for ejecting the fluid that is separate from a valid ejection processing for ejecting the fluid toward a target to be processed disposed at a predetermined position; and a preliminary ejection head cap device moisture retention unit for retaining moisture of the preliminary ejection head cap device, wherein the moisture retention head cap device is disposed so as to surround a periphery of the head to cover the whole of the head when retaining moisture of the head, and wherein the preliminary ejection head cap device moisture retention unit is (i) equipped with a preliminary ejection head cap device enclosure portion for surrounding a periphery of the preliminary ejection head cap device, and (ii) disposed so that the preliminary ejection head cap device enclosure portion is made contact with a bottom surface of the moisture retention head cap device when retaining moisture of the preliminary ejection head cap device, comprising steps of:

(i) step of forming first approximately sealed space between the moisture retention head cap device and the preliminary ejection head cap device;

(ii) step of forming second approximately sealed space between the bottom surface of the carriage and the moisture retention head cap device, while maintaining the first approximately sealed space;

(iii) step of transiting to power-off state or waiting state.

6. Method of operating the fluid ejection apparatus for ejecting a fluid according to claim 5, further comprising:

a carriage for holding the head, wherein a sealing member is provided on at least a bottom surface of the carriage and the moisture retention head cap device, and the moisture retention head cap device is made contact with an area outside the area on which the head is disposed among the bottom surface of the carriage via the sealing member to surround the periphery of the head.

7. Method of operating the fluid ejection apparatus for ejecting a fluid according to claim 5, further comprising:

a wiper for wiping the fluid adhered to an ejection surface of the head; and a wiper moisture retention unit for retaining moisture of the wiper.

8. Method of operating the fluid ejection apparatus for ejecting a fluid according to claim 7, wherein the wiper moisture retention unit is (i) equipped with a wiper enclosure portion for surrounding a periphery of the wiper, and (ii) disposed so that the wiper enclosure portion is made contact with a bottom surface of the moisture retention head cap device when retaining moisture of the wiper.

* * * * *